US006395109B1

(12) United States Patent
Peppler et al.

(10) Patent No.: US 6,395,109 B1
(45) Date of Patent: May 28, 2002

(54) BAR PRODUCT, CYLINDER RODS, HYDRAULIC CYLINDERS, AND METHOD FOR MANUFACTURING

(75) Inventors: William J. Peppler, Pine Springs; Dennis Harpole, Mendota Heights; Ken K. Wong, Woodbury, all of MN (US)

(73) Assignee: Cargill, Incorporated, Wayzata, MN (US)

( * ) Notice: Subject to any disclaimer, the term of this patent is extended or adjusted under 35 U.S.C. 154(b) by 0 days.

(21) Appl. No.: 09/504,287

(22) Filed: Feb. 15, 2000

(51) Int. Cl.[7] ..... C21D 8/06; C22C 38/44; C22C 38/48; C22C 38/50; C22C 38/46

(52) U.S. Cl. ..... 148/335; 148/598; 148/653; 148/654

(58) Field of Search ..... 148/598, 653, 148/335, 654, 595

(56) References Cited

U.S. PATENT DOCUMENTS

| | | | | |
|---|---|---|---|---|
| 3,626,734 A | | 12/1971 | Kotler | |
| 3,645,123 A | | 2/1972 | Auge | |
| 4,289,548 A | * | 9/1981 | Bucher et al. | 148/335 |
| 4,537,737 A | | 8/1985 | Crowe | |
| 4,594,113 A | | 6/1986 | Elsner et al. | |
| 4,631,948 A | | 12/1986 | Bald et al. | |
| 4,696,498 A | | 9/1987 | Church | |
| 4,715,203 A | | 12/1987 | Wiegenstein | |
| 4,806,177 A | | 2/1989 | Held et al. | |
| 5,180,927 A | | 1/1993 | Poletto | |
| 5,409,554 A | | 4/1995 | Leap | |
| 5,565,277 A | | 10/1996 | Cox, Jr. et al. | |
| 5,657,590 A | | 8/1997 | Digman et al. | |
| 5,845,363 A | | 12/1998 | Brempell et al. | |

FOREIGN PATENT DOCUMENTS

| | | |
|---|---|---|
| BE | 758169 A | 3/1971 |
| CA | 1 129 312 | 8/1982 |
| CA | 1 211 343 | 9/1986 |

(List continued on next page.)

OTHER PUBLICATIONS

Cline, R.S. et al., "Microalloyed Steel Bars and Forgings", *Journal of Metals*, pp. 26–30 (May 1986).

"Standard Specification for Cold–Drawn, Stress–Relieved Carbon Steel Bars Subject to Mechanical Property Requirements", *ASTM Designation: A 311/A 311M–95*, pp. 127–130 (1995).

*Primary Examiner*—Deborah Yee
(74) *Attorney, Agent, or Firm*—Jeffrey J. Skelton

(57) ABSTRACT

A bar product prepared from microalloyed bar steel is provided. The bar product is prepared by hot rolling and heat treating a microalloyed bar steel. The hot rolled and heat treated microalloyed bar steel is prepared by steps of hot rolling a preform of the microalloyed bar steel at a temperature of between about 1,400° F. and about 2,200° F. to provide a steel bar having a diameter of between about ¾ inch and about four inches, cooling the steel bar to provide a surface temperature of below about 1,100° F., and heat treating the steel bar in an environment having a temperature of between about 500° F. and about 1,300° F. The bar product is preferably prepared without a step of cold drawing. In particular, the bar product is preferably prepared without a step of drawing to provide a 10% to a 35% reduction. The bar product having a diameter of between about ¾ inch and about four inches can be characterized as having a tensile strength of greater than about 105 ksi, a yield strength of greater than about 90 ksi, and elongation in two inches of greater than about 7%, and a reduction of area of greater than about 20%. The invention relates to cylinder rods, hydraulic cylinders, methods for manufacturing cylinder rods and hydraulic cylinders.

26 Claims, 2 Drawing Sheets

FOREIGN PATENT DOCUMENTS

| | | | |
|---|---|---|---|
| CA | 1 301 489 | | 5/1992 |
| CA | 2 209 469 | | 3/1998 |
| CN | 1194339 | A | 9/1998 |
| DD | 272973 | A | 11/1989 |
| DE | 2530411 | A | 1/1977 |
| DE | 2919263 | A | 11/1980 |
| DE | 3138683 | A | 3/1983 |
| DE | 2856842 | C | 6/1988 |
| DE | 3743444 | A | 1/1989 |
| DE | 4038446 | A | 6/1992 |
| DE | 197 57 359 | A1 | 7/1998 |
| EP | 0 620 284 | A2 | 10/1994 |
| EP | 0 934 782 | A2 | 8/1999 |
| FR | 2 384 567 | A | 11/1978 |
| FR | 2 465 109 | A | 4/1981 |
| FR | 2 488 279 | A | 2/1982 |
| GB | 1 275 827 | | 5/1972 |
| GB | 1 505 247 | | 3/1978 |
| GB | 2 033 834 | A | 5/1980 |
| GB | 2 191 506 | A | 12/1987 |
| GB | 2 198 982 | A | 6/1988 |
| GB | 2 235 895 | A | 3/1991 |
| JP | 53024421 | A | 3/1978 |
| JP | 8333627 | A * | 12/1996 |
| KR | 9501938 | B1 | 3/1995 |
| NL | 7316500 | A | 6/1975 |
| SU | 350537 | A | 2/1973 |
| SU | 364365 | A | 4/1973 |
| SU | 440510 | A | 2/1975 |
| SU | 461769 | A | 6/1975 |
| SU | 494428 | A | 12/1975 |
| SU | 327733 | A | 5/1978 |
| SU | 6436725 | A | 1/1979 |
| SU | 704697 | A | 12/1979 |
| SU | 759152 | B | 8/1980 |
| SU | 773080 | B | 10/1980 |
| SU | 774669 | B | 10/1980 |
| SU | 798374 | B | 1/1981 |
| SU | 881273 | B | 11/1981 |
| SU | 954424 | A | 8/1982 |
| SU | 959878 | A | 9/1982 |
| SU | 961854 | A | 9/1982 |
| SU | 984539 | A | 12/1982 |
| SU | 986525 | A | 1/1983 |
| SU | 1015988 | A | 5/1983 |
| SU | 1033257 | A | 8/1983 |
| SU | 1063561 | A | 12/1983 |
| SU | 1084313 | A | 4/1984 |
| SU | 1088822 | A | 4/1984 |
| SU | 1094640 | A | 5/1984 |
| SU | 1100423 | A | 6/1984 |
| SU | 1158261 | A | 5/1985 |
| SU | 1180123 | A | 9/1985 |
| SU | 1224064 | A | 4/1986 |
| SU | 1252391 | A | 8/1986 |
| SU | 1258520 | A | 9/1986 |
| SU | 1258871 | A | 9/1986 |
| SU | 1273200 | A | 11/1986 |
| SU | 1279726 | A | 12/1986 |
| SU | 1323829 | A | 7/1987 |
| SU | 1325180 | A | 7/1987 |
| SU | 1346320 | A | 10/1987 |
| SU | 1349812 | A | 11/1987 |
| SU | 1360832 | A | 12/1987 |
| SU | 1362503 | A | 12/1987 |
| SU | 1375780 | A | 2/1988 |
| SU | 1388451 | A | 4/1988 |
| SU | 1406201 | A | 6/1988 |
| SU | 1437548 | A | 11/1988 |
| SU | 1505614 | A | 9/1989 |
| SU | 1516188 | A | 10/1989 |
| SU | 1534087 | A | 1/1990 |
| SU | 1569111 | A | 6/1990 |
| SU | 1574671 | A | 6/1990 |
| SU | 1680795 | A1 | 9/1991 |
| SU | 1810225 | A1 | 4/1993 |
| SU | 1833282 | A3 | 8/1993 |
| WO | WO 97/26379 | | 7/1997 |
| WO | WO 97/26385 | | 7/1997 |

* cited by examiner

BAR PRODUCT, CYLINDER RODS, HYDRAULIC CYLINDERS, AND METHOD FOR MANUFACTURING

FIELD OF THE INVENTION

The invention relates to bar product, cylinder rods, hydraulic cylinders, and methods for manufacturing bar product, cylinder rods, and hydraulic piston cylinders. More particularly, the invention relates to bar product prepared from microalloyed bar steel and which can be formed into cylinder rods for use in hydraulic cylinders. The bar product and cylinder rods can be prepared without a step of cold drawing.

BACKGROUND OF THE INVENTION

Manufacturers of hydraulic cylinders often require cylinder rods that satisfy the chemical and property requirements of ASTM A 311. Bar steel used in the manufacture of hydraulic cylinders is conventionally heavy-draft cold-drawn and stress-relieved and satisfies the chemical and property requirements of ASTM A 311-Class B.

Cylinder rods can be produced from bar steel and processed according to ASTM A 311. Bar steel characterized as grade C1045 or grade C1050 according to ASTM A 311 is melted and cast into a preform. The preform can typically be considered a billet, bloom, or ingot. The preform is reheated to a working temperature of about 2,000° F., and is hot rolled on a multiple stand bar rolling mill to provide a desired round size steel bar. The steel bar is cooled to below 1,000° F. on a notch-bar cooling bed. The cooled bar can be referred to as "as-hot rolled bar." The as-hot rolled bar is typically shipped to a cold finished bar producer for further processing. The mill scale is typically removed by shot blasting. The as-hot rolled bar is cold drawn to a smaller cross section by pulling it through a lubricated die. The standard draft for the cold finished bar industry is 1/16 inch. A heavy draft is typically 1/8 inch to 3/32 inch depending on the desired properties and finished cold drawn size. The reduction provided by a heavy draft results in additional strength. The cold drawn bars are straightened, and given a stress relief heat treatment to relieve drawing stress and increase the yield strength. The stress relief heat treatment is typically provided at about 500° F. to about 700° F. The resulting bars are typically processed by any or all of the following processing steps including turning, grinding, polishing, surface hardening and chrome plating to achieve a precision size and surface finish.

Microalloyed steel generally contains of one or more of columbium (niobium), vanadium, titanium, and nitrogen. These elements can be added to a base steel composition such as grade C1045 or grade C1050, and strength can be increased by a combination of grain refinement and precipitation strengthening. Because the microstructure of the steel remains predominantly pearlitic at the carbon levels provided by grade C1045 and grade C1050, ductility at a given strength level is relatively low, and tends to decrease proportionately as tensile strength increases. Yield strengths above 100 ksi can be achieved for microalloyed steel, but the ductility may not meet the requirements of ASTM A 311, Table 2. Steel companies have improved ductility in high strength microalloyed steel by lowering the amount of carbon and compensating for the resulting strength decrease by adding manganese and other elements. Hydraulic cylinder rod producers, however, have been reluctant to accept cylinder bars which are not certified as meeting the requirements of grade C1045 and C1050 according to ASTM A 311.

One concern is that lower carbon steel will not respond to the induction hardening commonly performed to improve wear at the rod surface.

SUMMARY OF THE INVENTION

A bar product prepared from microalloyed bar steel is provided according to the invention. The bar product is prepared by hot rolling and heat treating a microalloyed bar steel. The hot rolled and heat treated microalloyed bar steel is prepared by steps of hot rolling a preform of the microalloyed bar steel at a temperature of between about 1,400° F. and about 2,300° F. to provide a steel bar having a diameter of between about ¾ inch and about four inches, cooling the steel bar to provide a surface temperature of below about 1,100° F., and heat treating the steel bar in an environment having a temperature of between about 500° F. and about 1,300° F. The bar product is preferably prepared without a step of cold drawing. In particular, the bar product is preferably prepared without a step of drawing to provide a 10% to a 35% reduction.

The bar product having a diameter of between about ¾ inch and about four inches can be characterized as having a tensile strength of greater than about 105 ksi, a yield strength of greater than about 90 ksi, an elongation in two inches of greater than about 7%, and a reduction of area of greater than about 20%.

The microalloyed bar steel preferably includes about 0.36 wt. % to about 0.55 wt. % carbon, about 0.60 wt. % to about 1.65 wt. % manganese, 0 to about 0.050 wt. % phosphorus, 0 to about 0.050 wt. % sulfur, 0 to about 0.40 wt. % silicon, 0 to about 0.06 wt. % tin, 0 to about 0.40 wt. % copper, about 0.01 wt. % to about 0.40 wt. % nickel, about 0.01 wt. % to about 0.30 wt. % chromium, about 0.01 wt. % to about 0.15 wt. % molybdenum, and about 0.005 wt. % to about 0.50 wt. % microalloying additive comprising at least one of columbium (niobium), vanadium, titanium, aluminum and nitrogen. Preferably, the microalloyed bar steel includes about 0.02 wt. % to about 0.40 wt. % vanadium and between about 0.005 and about 0.025 wt. % nitrogen. More preferably, the microalloyed bar steel includes between about 0.005 wt. % and about 0.10 wt. % columbium (niobium), between about 0.02 and about 0.40 wt. % vanadium, and between about 0.005 wt. % and about 0.025 wt. % nitrogen. The microalloyed bar steel can additionally include between about 0.005 wt. % and about 0.05 wt. % titanium and between about 0.020 wt. % and about 0.060 wt. % aluminum. The microalloyed bar steel preferably includes between about 95.5 wt. % and about 99.0 wt. % iron.

The bar product can be further processed to provide a cylinder rod according to the invention. Exemplary processing steps can include turning, grinding, and/or polishing to provide a precision size. In addition, the surface of the bar product can be surface hardened and/or chrome plated.

A method for manufacturing bar product is provided according to the invention. The method includes steps of hot rolling the microalloyed bar steel at a temperature of between about 1,400° F. and about 2,300° F. to provide a steel bar having a diameter of between about ¾ inch and about four inches, cooling the bar steel to provide a surface temperature below about 1,100° F., and heat treating the steel bar at a temperature of between about 500° F. and about 1,300° F. The bar product can be further processed by steps of turning, grinding, and/or polishing to provide a precision size, and the surface of the bar product can be surface hardened and chrome plated. The method can be used to provide a cylinder rod for as a piston in a hydraulic cylinder.

A hydraulic cylinder is provided according to the invention. The hydraulic cylinder includes a housing and a cylinder rod provided within the housing. The housing includes an opening through which the cylinder rod extends. The cylinder rod includes a first end and a second end. The first end extends out of the housing through the housing opening and is generally attached to a saddle which is then attached to a substrate. The second end generally remains within the housing. The housing additionally contains a surface for mounting to another substrate.

DETAILED DESCRIPTION OF THE PREFERRED EMBODIMENT

Figure 1:
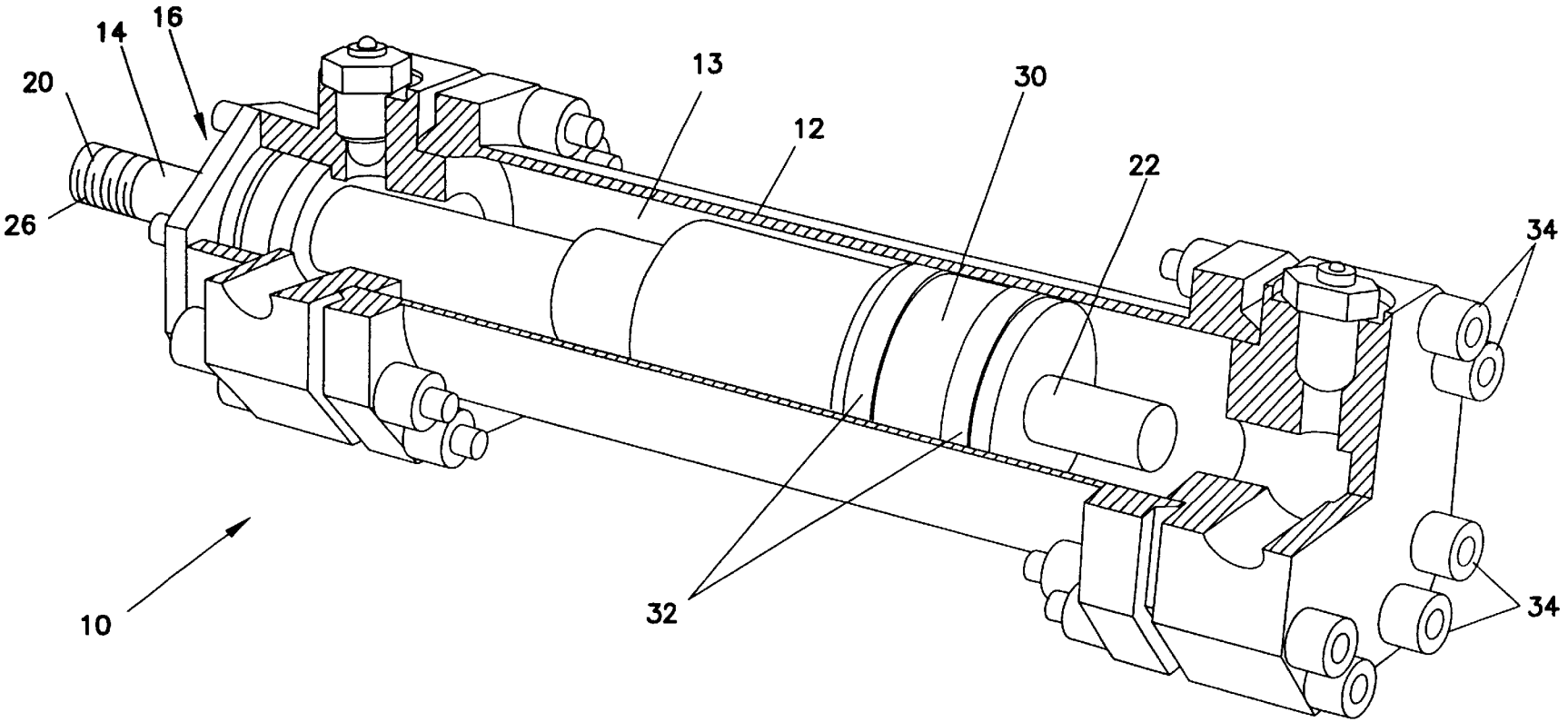
FIG. 1 is a cut away view of a hydraulic cylinder according to the invention.

The invention relates to bar product and cylinder rods prepared from microalloyed bar steel. Cylinder rods are commonly used as pistons in hydraulic cylinders. Cylinder rods are generally prepared from bar product.

It is often desirable to provide cylinder rods for use in hydraulic cylinders that comply with the chemical requirements of grade C1045 or grade C1050 according to ASTM A 311 and the physical properties of Class B according to ASTM A 311. Accordingly, the cylinder rods according to the invention preferably include between 0.43 wt. % and 0.55 wt. % carbon, between 0.60 wt. % and 0.90 wt. % manganese, 0 to 0.050 wt. % phosphorus, and 0 to 0.050 wt. % sulfur. In addition, cylinder rods according to the invention preferably exhibit properties of tensile strength, yield strength, elongation in two inches, and reduction of area corresponding to those property values identified in Table 2, Class B of ASTM A 311 for grades C1045 and C1050. The property values provided in Table 2, Class B of ASTM A 311 for grades C1045 and C1050 are incorporated herein by reference. For cylinder rods prepared from grade C1045 bar steel and having a diameter up and including two inches, the tensile strength is preferably at least 115 ksi, the yield strength is preferably at least 100 ksi, the elongation in two inches is preferably at least 10%, and the reduction of area is preferably at least 25%. For cylinder rods prepared from grade C1045 bar steel having a diameter of over two inches and up to three inches, the tensile strength is preferably at least 115 ksi, the yield strength is preferably at least 100 ksi, the elongation in two inches is preferably at least 9%, and the reduction of area is preferably at least 25%. For cylinder rods prepared from grade C1045 bar steel, and having a diameter of over three inches and up to four inches, the tensile strength is preferably at least 105 ksi, the yield strength is preferably at least 90 ksi, the elongation in two inches is preferably at least 7%, and the reduction of area is preferably at least 20%. For cylinder rods prepared from grade C1050 bar steel and having a diameter of up to 2 inches, the cylinder rod preferably exhibits a tensile strength of at least 115 ksi, a yield strength of at least 100 ksi, an elongation in two inches of at least 8%, and a reduction of area of at least 25%. For cylinder rods prepared from C1050 bar steel and having a diameter of greater than two inches and up to three inches, the tensile strength is preferably at least 115 ksi, the yield strength is preferably at least 100 ksi, the elongation in two inches is preferably at least 8%, and the reduction of area is at least about 20%. For cylinder rods prepared from grade C 1050 bar steel and having a diameter of greater than three inches and up to 4.5 inches, the cylinder rod preferably exhibits a tensile strength of at least 115 ksi, a yield strength of at least 100 ksi, an elongation in 2 inches of at least 7%, and a reduction of area of at least 20%. The bar product and cylinder rods according to the invention preferably satisfy these physical properties. It should be appreciated that the physical properties are measured according In order to achieve the desired physical properties of strength and ductility from steel having the chemistry identified by grade C1045 and grade C1050, prior art cylinder rods are prepared by a method which includes a step of cold drawing. In general, the step of cold drawing is generally referred to as heavy draft cold drawing which generally refers to providing about 10% to about 35% reduction. It is an advantage of the invention that the microalloyed bar steel can be processed to provide the desired properties without a step of cold drawing. In particular, the bar product can be processed into cylinder rods without processing by heavy draft which provides about 10% to about 35% reduction.

Microalloyed bar steel refers to bar steel containing microalloying elements. The microalloyed bar steel according to the invention can be referred to more simply as bar steel. The bar steel includes between about 0.36 wt. % and about 0.55 wt. % carbon, between about 0.60 wt. % and about 1.65 wt. % manganese, 0 to about 0.050 wt. % phosphorous, 0 to about 0.050 wt. % sulfur, 0 to about 0.40 wt. % silicon, 0 to about 0.06 wt. % tin, 0 to about 0.40 wt. % copper, between about 0.01 wt. % and about 0.40 wt. % nickel, between about 0.01 wt. % and about 0.30 wt. % chromium, between about 0.01 wt. % and about 0.15 wt. % molybdenum, and between about 0.005 wt. % and about 0.50 wt. % of a microalloying additive including at least one of columbium (niobium), vanadium, titanium, aluminum, and nitrogen. In most bar steel compositions, it is expected that phosphorous, sulfur, silicon, tin, and copper will be present, although the amount of these components can be taken to very low levels. When phosphorous is present, it is generally provided at a level of greater than about 0.005 wt. %. When sulfur is present, it is generally provided at a level of greater than about 0.005 wt. %. When silicon is present, it is generally provided at a level of greater than about 0.01 wt. %. When tin is present, it is generally provided at a level of greater than about 0.002 wt. %. When copper is present, it is generally provided at a level of greater than about 0.01 wt. %.

The microalloying additives are preferably provided at a concentration which provides the cylinder rods according to the invention with the desired physical properties. Preferably, the microalloyed bar steel includes 0 to about 0.10 wt. % columbium (niobium), about 0.02 wt. % to about 0.40 wt. % vanadium, 0 to about 0.05 wt. % titanium, 0 to about 0.060 wt. % aluminum, and between about 0.005 wt. % and about 0.025 wt. % nitrogen. More preferably, the microalloyed bar steel includes between about 0.02 wt. % and about 0.05 wt. % columbium (niobium), between about 0.25 wt. % and about 0.35 wt. % vanadium, and between about 0.005 wt. % and about 0.025 wt. % nitrogen. In addition, the microalloyed bar steel can include at least about 0.005 wt. % titanium and preferably between about 0.01 wt. % an about 0.02 wt. % titanium, and at least about 0.020 wt. % aluminum and preferably between about 0.020 wt. % and about 0.040 wt. % aluminum. Although the ranges of components of the microalloyed bar steel include the adjective "about" it should be appreciated that the ranges can be provided without the use of this adjective.

The microalloyed bar steel can be prepared by melting the microalloyed bar steel components to form a liquid metal bath. Starting materials for the liquid metal bath can include steel scrap. Once the liquid metal bath is prepared having the desired composition, the liquid steel bath is preferably cast into preforms. The preforms can be characterized as billets, blooms, or ingots.

The cast preforms are reheated to between about 1,400° F. and about 2,300° F. and hot rolled to provide a steel bar having a desired diameter. Preferably, the preforms are heated to at least about 2,000° F., and generally to less than about 2,200° F. In general, the steel bar will be further processed before arriving at the final cylinder rod product. Accordingly, the diameter of the steel bar is slightly larger than the diameter of the cylinder rod because it is expected that the surface will be processed to provide a precision sized cylinder rod. In general, the preforms are hot rolled to provide a steel bar having a diameter of between about ¾ inch and about 4 or 4½ inches.

The steel bar is cooled, and the resulting cooled steel bar can be referred to as "as-hot rolled bar." In general, as-hot rolled bar is cooled at least enough to provide the bar with a black color on its surface. In general, this corresponds to a surface temperature below about 1,100° F. The step of cooling can include controlled cooling which is a technique generally recognized in the industry for producing bar steel.

The as-hot rolled bar is preferably heat treated. The heat treatment generally includes heating the as-hot rolled bar to a temperature of between about 500° F. and about 1300° F. Preferably, the as-hot rolled bar is heated to a temperature of between about 550° F. and about 1250° F., and more preferably between about 1000° F. and about 1100° F. The length of time provided at this temperature generally depends on the diameter of the as-hot rolled bar and the furnace type. Conventional furnaces include gas fired furnaces and induction furnaces. For a conventional gas fired furnace, it is generally desirable to expose the as-hot rolled bar to an environment having the temperature identified above for 40 minutes per inch of diameter. Accordingly, for as-hot rolled bar having a diameter of between about ¾ inch and about 4 inches, it is generally desirable to expose the as-hot rolled bar to an environment at the temperature identified above for between about 20 minutes and about 12 hours, and in general, less than about 8 hours. In the case of an induction, furnace, the length of time for heat treating can be as low as two minutes. Accordingly, the step of heat treating can take place for between about two minutes and about 12 hours depending upon the temperature of the environment, the type of furnace, and the diameter of the as-hot rolled bar.

The amount of heat treatment is conducted for a length of time and at a temperature to provide desired elongation and reduction of area properties while maintaining desired tensile strength and yield strength properties. The applicants discovered that by providing the as-hot rolled bar with sufficiently high tensile strength and yield strength properties, it is possible to increase the elongation and reduction of area properties by heat treatment without reducing the tensile strength and yield strength properties to undesirable values.

The heat treated, as-hot rolled bar can be referred to as bar product. The bar product can be further processed to provide cylinder rods which can be used in hydraulic cylinders. Exemplary processing steps include turning, grinding, and polishing to provide a precision size. In addition, the surface is preferably finished, surface hardened, and chrome plated. An exemplary surface hardening technique which can be practiced includes nitriding or nitrogen surface-hardening.

The invention can be practiced without the cold drawing operation provided by the prior art. By eliminating the cold drawing operation, a significant reduction in the cost of manufacturing the cylinder rod can be provided.

Now referring to FIG. 1, a cut-away view of a hydraulic cylinder is shown at reference numeral 10. The hydraulic piston cylinder 10 includes a cylinder housing 12 and a cylinder rod or piston 14. The cylinder housing 12 provides an internal area 13. The cylinder rod or piston 14 is constructed for sliding within the opening 16 of the cylinder housing 12. The cylinder rod 14 is shown having a first end 20 and a second end 22. The first end 20 slides within the opening 16. As shown, the first end 20 includes threads 26 for attachment to a saddle. Alternatively, the saddle can be welded to the first end 20. The second end 22 generally slides within the cylinder housing 12. As shown, a piston 30 can be provided with seals 32 at the second end 22. The housing 12 preferably includes head securing screws 34 or some other mechanism for attachment to a substrate.

Example 1

This example demonstrates the production of bar product having desired properties for use as a cylinder rod without processing by a step of cold drawing. For example, microalloyed bar steel A was prepared according to the chemistry shown in Table 1. The amounts of each component identified in Table 1 is provided on a weight percent basis. The chemistry of the microalloyed bar steel A satisfies the requirements of grade C1045 according to ASTM A 311, and includes the addition of microalloying elements columbium (niobium) and vanadium. Nitrogen was also added above typical Electric Arc Furnace levels to enhance the strengthening effect of the vanadium addition. The balance of microalloyed bar steel A is iron.

TABLE 1

| C | Mn | P | S | Si | Sn | Cu | Ni | Cr | Mo | Cb | Va | N |
|---|---|---|---|---|---|---|---|---|---|---|---|---|
| 0.50 | 0.85 | 0.014 | 0.018 | 0.24 | 0.016 | 0.32 | 0.21 | 0.17 | 0.06 | 0.024 | 0.26 | 0.017 |

Microalloyed bar steel A was continuously cast to form 5½" square billets, and hot rolled to a number of bar sizes to determine the hot rolled mechanical properties prior to heat treating. The bars were cooled separately on a moveable notch hotbed until they were below the coarsening temperature of the microalloy constituents.

Figure 2:
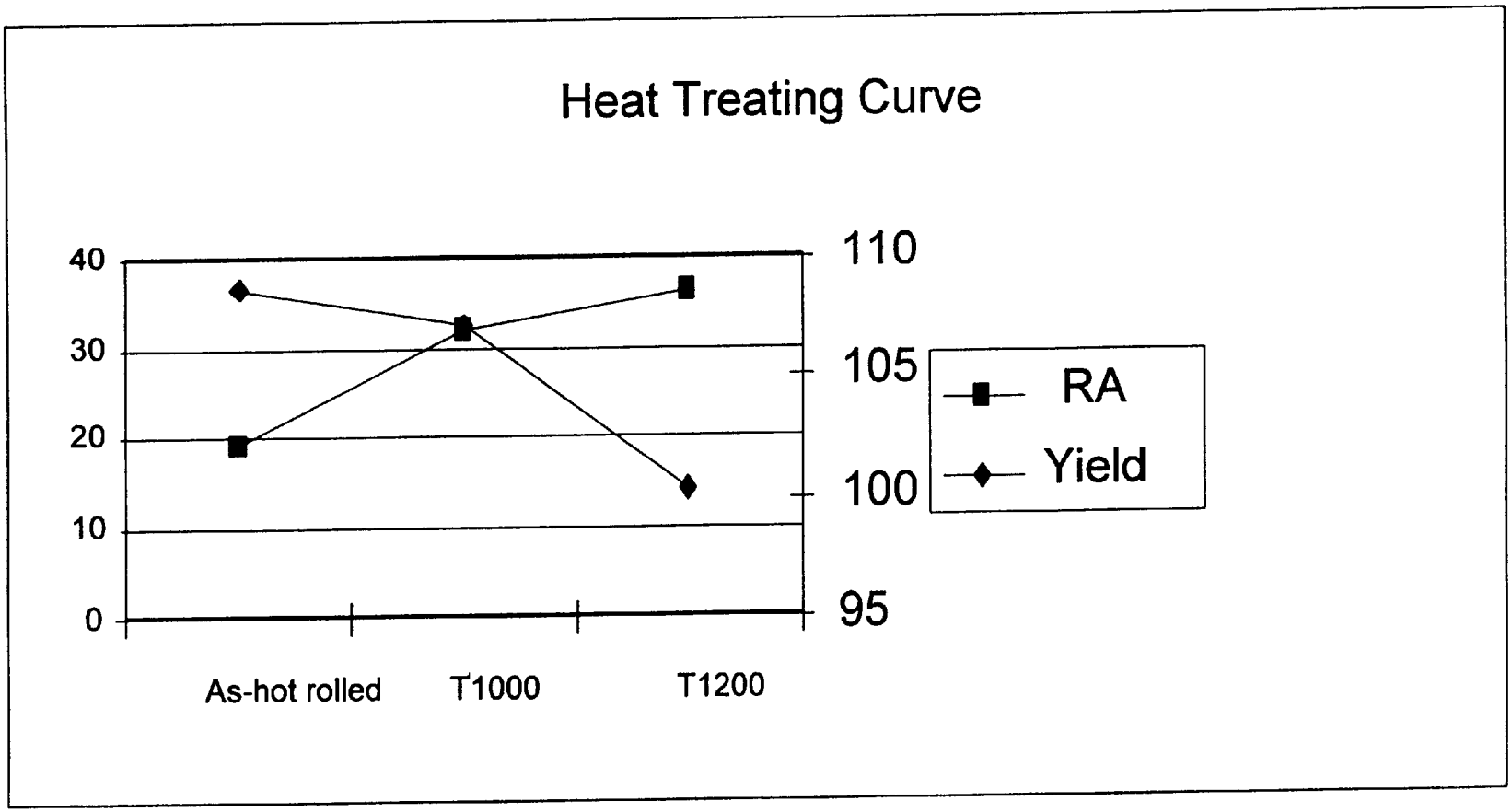
FIG. 2 is a graph illustrating the effect of heat treating on yield strength and reduction of area according to example 1.

FIG. 2 illustrates the effect of heat treating on yield strength and reduction of area. The as-hot rolled bars rolled to 1 9/16" round sections had yield strengths of 109 ksi, which is well above the 100 ksi minimum required by ASTM A 311, Class B. The reduction in area (RA) was 19% which is well below the 25% minimum required by ASTM A 311, Class B.

Samples from this rolling were held at varying temperatures in a small furnace to determine the tempering response for the material. As the heat treating temperature increased from 1000° F. to 1200° F., an increase in ductility and a decrease in yield strength was observed. It should be apparent that chemistries without sufficient yield strength in the as-hot rolled condition may not remain above 100 ksi yield strength if the steel is heat treated to meet the required reduction in area. In fact, previous attempts to produce the subject material were unsuccessful due to as-hot rolled yield strengths that were just above 100 ksi.

Heat treating curves in the small furnace were used for reference. North Star Saint Paul has a 60 ft., reciprocating hearth furnace with a 60,000 ton capacity. An evaluation lot of 1 9/16 rd. produced in the furnace was initially heat treated at 1050° F. based on the heat treating curves obtained in the lab. The reduction in area at that temperature was below the 25% minimum required by ASTM A 311, Class B. 1100° F. was provided to bring the reduction of area to 27%, with minimal loss in yield strength. Additional heat treating may have further increased the reduction of area (RA), but it is expected that strength would have dropped as FIG. 2 suggests.

It is believed that the microalloyed steels according to the invention achieve their mechanical property characteristics from the interaction of the chemical composition and thermo-mechanical processing. The microalloyed steel bars according to the invention exhibit higher strength in the as rolled condition in comparison to standard plain carbon or many low alloy steel bars.

Example 2

Microalloyed bar steel B-F were prepared having the chemistry identified in Table 2. The components are provided on a weight percent basis, and the balance of the microalloyed bar steel is iron. The microalloyed bar steel was hot rolled to provide a steel bar having a diameter of 1 9/16 inches. The resulting properties of yield strength, tensile strength, percent elongation and percent reduction of area for the steel bars are reported in Table 2. The properties reported in Table 2 are for the steel bars prior to heat treatment according to the invention.

TABLE 2

| Micro-alloyed Bar Steel | C | Mn | P | S | Si | Sn | Cu | Ni | Cr | Mo | Cb | V | N | Diameter (inches) | Yield (ksi) | Tensile (ksi) | Elong. % | RA % |
|---|---|---|---|---|---|---|---|---|---|---|---|---|---|---|---|---|---|---|
| B | 0.44 | 0.86 | 0.015 | 0.018 | 0.27 | 0.014 | 0.29 | 0.15 | 0.23 | 0.04 | 0.002 | 0.22 | 0.0092 | 1.5625 | 100.9 | 143.7 | 10 | 20 |
| C | 0.45 | 0.85 | 0.01 | 0.016 | 0.28 | 0.007 | 0.35 | 0.15 | 0.17 | 0.04 | 0.003 | 0.241 | 0.0138 | 1.5625 | 105.2 | 146.1 | 12 | 26 |
| D | 0.45 | 0.85 | 0.01 | 0.016 | 0.28 | 0.007 | 0.35 | 0.15 | 0.17 | 0.04 | 0.003 | 0.241 | 0.0138 | 1.5625 | 107.4 | 151.3 | 10 | 18 |
| E | 0.47 | 0.83 | 0.01 | 0.017 | 0.26 | 0.008 | 0.2 | 0.19 | 0.16 | 0.03 | 0.021 | 0.26 | 0.0131 | 1.5625 | 108.4 | 153.2 | 10 | 6 |
| F | 0.47 | 0.83 | 0.01 | 0.017 | 0.26 | 0.008 | 0.2 | 0.19 | 0.16 | 0.03 | 0.021 | 0.26 | 0.0131 | 1.5625 | 108.9 | 151.3 | 8 | 4 |

The above specification, examples and data provide a complete description of the manufacture and use of the composition of the invention. Since many embodiments of the invention can be made without departing from the spirit and scope of the invention, the invention resides in the claims hereinafter appended.

We claim:

1. A bar product comprising:

(a) hot rolled and heat treated microalloyed bar steel prepared by steps of:

(i) hot rolling a preform comprising the microalloyed bar steel at a temperature of between about 1,400° F. and about 2,300° F. to provide a steel bar having a diameter of between about ¾ inch and about 4 inches;

(ii) cooling the steel bar to provide a surface temperature below about 1,100° F.; and (iii) heat treating the steel bar in an environment at a temperature of between about 500° F. and about 1,300° F.;

(b) said microalloyed bar steel comprising:

(i) about 0.36 wt. % to about 0.55 wt. % carbon;

(ii) about 0.60 wt. % to about 0.90 wt. % manganese;

(iii) about 0.01 wt. % to about 0.40 wt. % nickel;

(iv) about 0.01 wt. % to about 0.30 wt. % chromium;

(v) about 0.01 wt. % to about 0.15 wt. % molybdenum; and (vi) about 0.005 wt. % to about 0.50 wt. % microalloying additive comprising at least one of columbium (niobium), vanadium, titanium, aluminum and nitrogen; and (c) said hot rolled and heat treated microalloyed bar steel having a tensile strength of greater than about 105 ksi, a yield strength of greater than about 90 ksi, an elongation in two inches of greater than about 7%, and a reduction of area of greater than about 20%.

2. A bar product according to claim 1, wherein said microalloyed bar steel comprises:

(i) about 0.02 wt. % to about 0.40 wt. % vanadium; and (ii) between about 0.005 and about 0.025 wt. % nitrogen.

3. A bar product according to claim 1, wherein said microalloyed bar steel comprises:

(i) between about 0.005 wt. % and about 0.10 wt. % columbium (niobium);

(ii) between about 0.02 and about 0.40 wt. % vanadium; and (iii) between about 0.005 wt. % and about 0.025 wt. % nitrogen.

4. A bar product according to claim 3, wherein said microalloyed bar steel comprises:

(i) between about 0.005 wt. % and about 0.05 wt. % titanium; and (ii) between about 0.020 wt. % and about 0.060 wt. % aluminum.

5. A bar product according to claim 1, wherein said microalloyed bar steel comprises:

(i) about 0.02 wt. % to about 0.05 wt. % columbium (niobium);

(ii) about 0.25 wt. % to about 0.35 wt. % vanadium;

(iii) about 0.01 wt. % to about 0.02 wt. % titanium;

(iv) about 0.020 wt. % to about 0.40 wt. % aluminum; and (v) about 0.005 wt. % to about 0.025 wt. % nitrogen.

6. A bar product according to claim 1, wherein said microalloyed bar steel comprises:

(i) between about 0.005 wt. % and about 0.050 wt. % phosphorous;

(ii) between about 0.005 wt. % and about 0.050 wt. % sulfur;

(iii) between about 0.01 wt. % and about 0.40 wt. % silicon;

(iv) between about 0.002 wt. % and about 0.06 wt. % tin; and (v) between about 0.01 wt. % and about 0.40 wt. % copper.

7. A bar product according to claim 1, wherein said microalloyed bar steel comprises between about 95.5 wt. % and about 99.0 wt. % iron.

8. A bar product according to claim 1, wherein said hot rolled and heat treated microalloyed bar steel is prepared without a step of cold drawing.

9. A bar product according to claim 1, wherein bar product comprises a cylinder rod prepared from the hot rolled and heat treated microalloyed bar steel by at least one of grinding, turning, and polishing.

10. A method for manufacturing bar product, the method comprising steps of:

(a) hot rolling microalloyed bar steel at a temperature of between about 1,400° F. and about 2,300° F. to provide a steel bar having a diameter of between about ¾ inch and about 4 inches, said microalloyed bar steel comprising:

(i) about 0.36 wt. % to about 0.55 wt. % carbon;

(ii) about 0.60 wt. % to about 0.90 wt. % manganese;

(iii) about 0.01 wt. % to about 0.40 wt. % nickel;

(iv) about 0.01 wt. % to about 0.30 wt. % chromium;

(v) about 0.01 wt. % to about 0.15 wt. % molybdenum; and (vi) about 0.005 wt. % to about 0.50 wt. % microalloying additive comprising at least one of columbium (niobium), vanadium, titanium, aluminum, and nitrogen;

(b) cooling the steel bar to provide a surface temperature below about 1,100° F.; and (c) heat treating the steel bar at a temperature of between about 500° F. and about 1,300° F.

11. A method for manufacturing bar product according to claim 10, wherein the steel bar provided from the step of heat treating has a tensile strength of greater than about 105 ksi, a yield strength of greater than about 90 ksi, an elongation into inches of greater than about 7%, and a reduction of area of greater than about 20%.

12. A method for manufacturing bar product according to claim 10, further comprising a step of:

(a) removing mill scale from the heat treated steel bar.

13. A method for manufacturing bar product according to claim 10, wherein the method does not include a step of cold drawing.

14. A method for manufacturing bar product according to claim 10, further comprising a step of:

(a) processing the heat treated steel bar by at least one of grinding, turning, and polishing to provide a precision size steel bar.

15. A method for manufacturing bar product according to claim 14, further comprising a step of:

(a) processing the precision size steel bar by at least one of surface hardening and chrome plating to provide a cylinder rod.

16. A method for manufacturing bar product according to claim 10, wherein said microalloyed bar steel comprises:

(i) about 0.02 wt. % to about 0.40 wt. % vanadium; and (ii) between about 0.005 and about 0.025 wt. % nitrogen.

17. A method for manufacturing bar product according to claim 10, wherein said microalloyed bar steel comprises:

(i) between about 0.005 wt. % and about 0.10 wt. % columbium (niobium);

(ii) between about 0.02 and about 0.40 wt. % vanadium; and (iii) between about 0.005 wt. % and about 0.025 wt. % nitrogen.

18. A method for manufacturing bar product according to claim 17, wherein said microalloyed bar steel comprises:

(i) between about 0.005 wt. % and about 0.05 wt. % titanium; and (ii) between about 0.020 wt. % and about 0.060 wt. % aluminum.

19. A method for manufacturing bar product according to claim 16, wherein said microalloyed bar steel comprises at least one of columbium (niobium), titanium, and aluminum.

20. A method for manufacturing bar product according to claim 10, wherein said microalloyed bar steel comprises:

(i) between about 0.005 wt. % and about 0.050 wt. % phosphorous;

(ii) between about 0.005 wt. % and about 0.050 wt. % sulfur;

(iii) between about 0.01 wt. % and about 0.40 wt. % silicon;

(iv) between about 0.002 wt. % and about 0.06 wt. % tin; and (v) between about 0.01 wt. % and about 0.40 wt. % copper.

21. A hydraulic cylinder comprising a housing having an internal area and an opening through the housing, and a cylinder rod provided in the internal area within the housing, the cylinder rod having a first end and a second end, the first end extending through the opening in the housing, the cylinder rod comprising:

(a) hot rolled and heat treated microalloyed bar steel prepared by steps of:

(i) hot rolling a preform comprising the microalloyed bar steel at a temperature of between about 1,400° F. and about 2,300° F. to provide a steel bar having a diameter of between about ¾ inch and about 4 inches;

(ii) cooling the steel bar to provide a surface temperature below about 1,100° F.; and (iii) heat treating the steel bar in an environment at a temperature of between about 500° F. and about 1,300° F.;

(b) said microalloyed bar steel comprising:

(i) about 0.36 wt. % to about 0.55 wt. % carbon;

(ii) about 0.60 wt. % to about 0.90 wt. % manganese;

(iii) 0 to about 0.050 wt. % phosphorus;

(iv) 0 to about 0.050 wt. % sulfur;

(v) 0 to about 0.40 wt. % silicon;

(vi) 0 to about 0.06 wt. % tin;

(vii) 0 to about 0.35 wt. % copper;

(viii) about 0.01 wt. % to about 0.40 wt. % nickel;

(ix) about 0.01 wt. % to bout 0.30 wt. % chromium;

(x) about 0.01 wt. % to about 0.15 wt. % molybdenum; and (xi) about 0.005 wt. % to about 0.50 wt. % microalloying additive comprising at least one of columbium (niobium), vanadium, titanium, aluminum and nitrogen; and (c) said hot rolled and heat treated microalloyed bar steel having a tensile strength of greater than about 105 ksi, a yield strength of greater than about 90 ksi, an elongation in two inches of greater than about 7%, and a reduction of area of greater than about 20%.

22. A hydraulic cylinder according to claim 21, wherein said microalloyed bar steel comprises:

(i) about 0.02 wt. % to about 0.40 wt. % vanadium; and (ii) between about 0.005 and about 0.025 wt. % nitrogen.

23. A hydraulic cylinder according to claim 21, wherein said microalloyed bar steel comprises:

(i) between about 0.005 wt. % and about 0.10 wt. % columbium (niobium);

(ii) between about 0.02 and about 0.40 wt. % vanadium; and (iii) between about 0.005 wt. % and about 0.025 wt. % nitrogen.

24. A hydraulic cylinder according to claim 23, wherein said microalloyed bar steel comprises:

(i) between about 0.005 wt. % and about 0.05 wt. % titanium; and (ii) between about 0.020 wt. % and about 0.060 wt. % aluminum.

25. A hydraulic cylinder according to claim 22, wherein said microalloyed bar steel comprises at least one of:

(i) between about 0.005 wt. % and about 0.10 wt. % columbium (niobium);

(ii) between about 0.005 wt. % and about 0.05 wt. % titanium; and (iii) between about 0.020 wt. % and about 0.060 wt. % aluminum.

26. A hydraulic cylinder according to claim 21, wherein said cylinder rod has not been drawn to provide a 10% to 35% reduction.

* * * * *